US006978766B2

(12) United States Patent
Schürz

(10) Patent No.: US 6,978,766 B2
(45) Date of Patent: Dec. 27, 2005

(54) CONTROL MODULE FOR A STORAGE-TYPE INJECTION SYSTEM INJECTOR

(75) Inventor: Willibald Schürz, Pielenhofen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/837,969

(22) Filed: May 3, 2004

(65) Prior Publication Data

US 2004/0200908 A1 Oct. 14, 2004

Related U.S. Application Data

(63) Continuation of application No. PCT/DE02/04152, filed on Nov. 8, 2002.

(30) Foreign Application Priority Data

Nov. 9, 2001 (DE) ..... 101 55 254

(51) Int. Cl.[7] ..... F02M 37/04
(52) U.S. Cl. ..... 123/467; 123/501
(58) Field of Search ..... 123/467, 500, 123/501, 446; 239/88–96

(56) References Cited

U.S. PATENT DOCUMENTS

| | | | | |
|---|---|---|---|---|
| 4,566,416 A | | 1/1986 | Berchtold | 123/458 |
| 5,890,471 A | | 4/1999 | Nishimura | 123/496 |
| 6,145,492 A | * | 11/2000 | Lixl | 123/467 |
| 6,305,355 B1 | | 10/2001 | Hoffmann et al. | 123/467 |
| 6,378,502 B1 | * | 4/2002 | Betz | 123/467 |
| 6,499,467 B1 | * | 12/2002 | Morris et al. | 123/467 |

FOREIGN PATENT DOCUMENTS

| | | | |
|---|---|---|---|
| DE | 44 46 269 A1 | 6/1996 | F02M 47/00 |
| DE | 199 49 527 A1 | 4/2001 | F02M 47/02 |
| DE | 100 63 083 A1 | 8/2002 | F02M 61/16 |
| EP | 0 450 532 A1 | 10/1991 | F02M 47/00 |
| EP | 1 273 791 A2 | 6/2002 | F02M 47/02 |
| JP | 10339239 A | 12/1998 | F02M 47/00 |
| SE | 668 621 | 1/1989 | F02M 45/00 |
| SE | 689 282 | 1/1999 | F02M 47/02 |

* cited by examiner

*Primary Examiner*—Carl S. Miller
(74) *Attorney, Agent, or Firm*—Baker Botts L.L.P.

(57) ABSTRACT

A control module (1) for an injector designed to control and guide a valve body (8) comprises a high-pressure supply element (2), a guiding device (3) for guiding the valve body, a control compartment (4), a control valve (10), a supply choke (5), first and second output chokes (6, 7). The supply choke physically represents a connection between the high pressure supply element (2) and a valve compartment (9). The first output choke (6) connects the control compartment linked to one end of the valve body, to the valve compartment (9). The second output choke (7) connects the valve compartment (9) to the control valve (10).

20 Claims, 3 Drawing Sheets

FIG 2 Section A-A
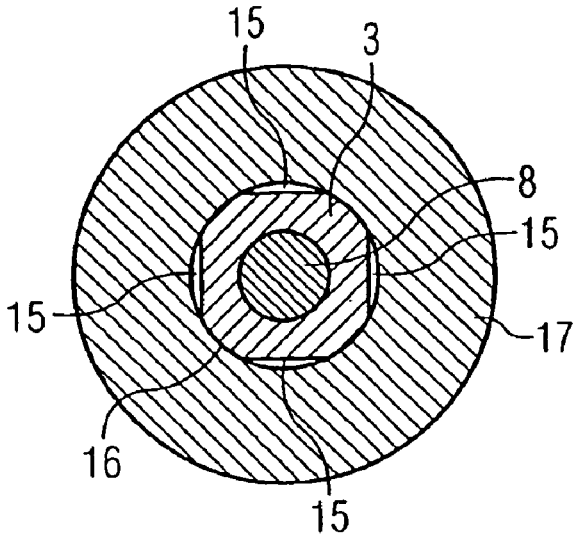
FIG 3
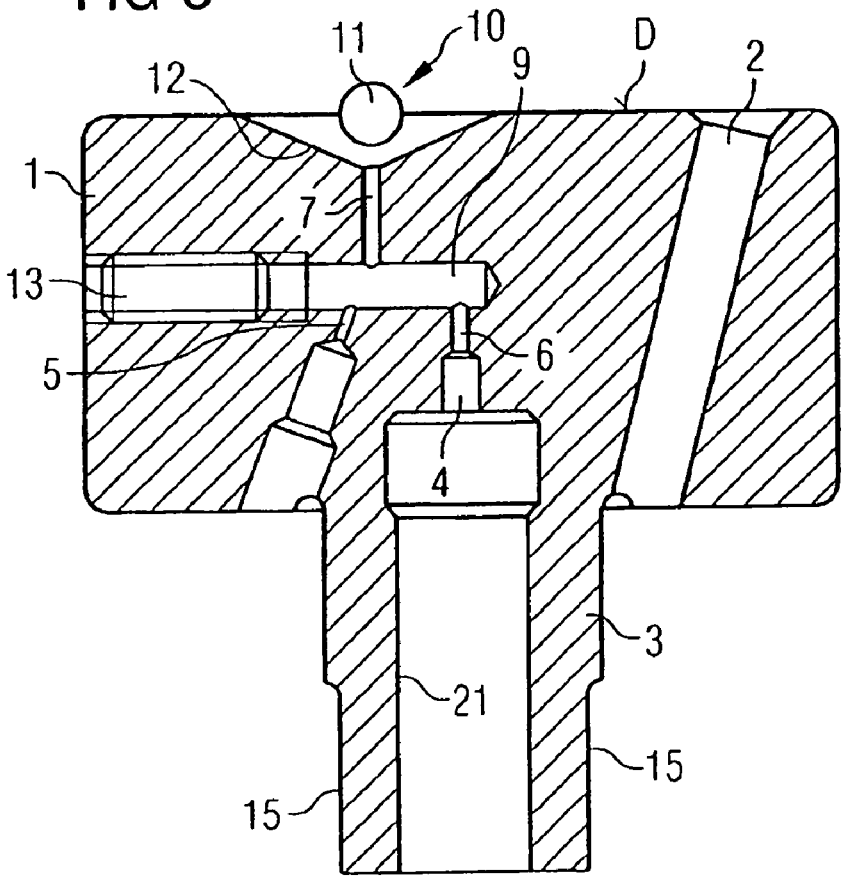

CONTROL MODULE FOR A STORAGE-TYPE INJECTION SYSTEM INJECTOR

CROSS REFERENCE TO RELATED APPLICATION

This application is a continuation of copending International Application No. PCT/DE02/04152 filed Nov. 8, 2002 which designates the United States, and claims priority to German application no. 101 55 254.8 filed Nov. 9, 2001.

TECHNICAL FIELD OF THE INVENTION

The invention relates to a control module for a storage-type injection system injector to control and simultaneously guide an injector valve body.

DESCRIPTION OF THE RELATED ART

Different embodiments of injectors for storage-type injection systems are known. One such known injector is shown in FIG. 4 for example. Here fuel is supplied to the area around the nozzle needle 36 via a high-pressure supply line 30. The nozzle needle 36 is in contact with a control piston 31, one end of which is arranged in a control compartment 32. The pressure in the control compartment 32 can be controlled in the known manner by means of a control valve 33, so that the control compartment 32 can be connected to a tank T. The side of the control piston 31 opposite the control compartment 32 is in contact with a low-pressure compartment 34, which is connected via a low-pressure output element 35 to the tank T. This allows the nozzle needle 36 to be raised from its seat in the known manner, resulting in injection. However this causes a major drop in pressure in the control compartment 33, which can result in cavitation problems and longer closure times due to gas bubbles.

With the injector design shown in FIG. 4 continuous leakage occurs both in the nozzle needle guide 37 and in the guide 38 for the control piston 31, as the compartments subject to high pressure are connected to the low-pressure compartment 34 via sealed gaps. A quantity of fuel therefore flows from the high-pressure area via the two guides 37 and 38 to the low-pressure compartment 34. However this continuous leakage causes an efficiency loss that cannot be ignored.

Injectors are also known from the prior art, which have a bypass, to allow a direct connection between the high-pressure supply line and the control valve. This allows faster switching times to be achieved. However during injection there is both a connection from the high-pressure line via the bypass to the low-pressure area and from the high-pressure line via the supply choke and the control compartment to the low-pressure area. This means that losses during injection are not insignificant. Unwanted continuous leakage also occurs via the control piston with this system.

SUMMARY OF THE INVENTION

The object of the present invention is therefore to provide a control module without continuous leakage or an injector without continuous leakage for storage-type injection systems, which has a simple structure and is simple and economical to produce.

This object can be achieved by a control module for a storage-type injection system injector to control and guide a valve body, comprising a high-pressure supply element to supply fuel, a guiding device to guide the valve body, a control compartment, a control valve, a valve compartment, a supply choke, a first output choke and a second output choke, whereby the supply choke provides a connection between the high-pressure supply element and the valve compartment, the first output choke provides a connection between the control compartment, which is connected to one end of the valve body, and the valve compartment, and the second output choke connects the valve compartment to the control valve. The object can also be achieved by an injector for a storage-type injection system with such a control module.

The high-pressure supply element can be connected to the supply choke via an annular channel. The annular channel can be configured in a nozzle body and/or in the control module. The guiding device can be configured as a cylindrical extension. A connecting area can be provided on the outer periphery of the guiding device and/or on the inner periphery of the nozzle body to connect the high pressure supply element to a high-pressure area on the valve body. The connecting area can be formed by one or a plurality of recesses on the guiding device and/or on the nozzle body. The guiding device may have a recess to guide the valve body. A spring element to reset the valve body can be supported on the one hand on the guiding device and on the other hand on a spring plate arranged on the valve body. Centering surfaces can be configured on the guiding device to center the control module in the nozzle body. The valve body can be configured as a nozzle needle. In the control module all the functional elements to control and guide the valve body of the injector can be combined in one component. The high-pressure supply element can be connected to the supply choke via an annular channel, which is preferably configured in a nozzle body and/or in the control module. The valve compartment can be formed by a lateral hole in the control module. The valve body can be configured as a single nozzle needle, one end of which is connected to the control compartment and the other end of which releases or closes injection openings.

The inventive control module for a storage-type injection system injector provides for an injector without continuous leakage, in that all the functional elements to control and guide the valve body of the injector are combined in one component. This means there is a minimum number of high-pressure sealed surfaces. The high-pressure sealed surfaces are thereby only configured as planes, which can be sealed relatively easily. There is therefore no need for the cylindrical guide surfaces used in the prior art, which are subject to continuous leakage due to the gap there. Also according to the invention there is no need for the provision of a bypass, without any disadvantages in respect of switching times. This can be achieved, as according to the invention optimum design is possible for the choke cross-sections of the different chokes of the control module. The inventive control module thereby comprises a high-pressure supply element to supply fuel, a guiding device to guide the valve body of the injector, a control compartment, a control valve and a valve compartment. A supply choke and a first and second output choke are also provided. The control compartment, which is connected to one end of the valve body, is thereby only connected to the valve compartment via a first output choke. The supply choke also connects the high-pressure supply line to the valve compartment. A second output choke goes out from the valve compartment to the control valve. Unlike the prior art there is no direct connection between the control compartment and the high-pressure supply line. The control compartment is only connected to the high-pressure line via the first output choke and the valve compartment and supply choke. Therefore when the control valve is opened, fluid flows out of the control compartment via the first output choke and when the control valve is closed, the control compartment is filled again through the first output choke, whereby the flow direction in the first output choke reverses. The inventive use of an additional valve compartment also means that the pressure level in the control compartment is higher when the control valve is opened. This means there is no longer a risk of cavitation bubbles forming, which in the prior art result in both damage to the components and delays in closing the nozzle needle. The volume flow flowing out through the control valve when the nozzle needle opens is also smaller, with the result that the control cross-section required at the control valve to prevent choking effects at the control valve is reduced. Also when the injector is open, there is only switching leakage due to the volume flow through the supply choke, the valve compartment and the control valve to the low-pressure area. Also according to the invention a larger design margin can be maintained for the individual choke cross-sections, to be able to satisfy the requirements in respect of the smallest representable injection quantity from the injection nozzle into the combustion chamber and the minimum nozzle opening pressure. This means that for a predefined, maximum permissible volume flow at the control valve seat the choke cross-sections can be larger than in the prior art. This reduces sensitivity in respect of manufacturing tolerances, so manufacturing costs can be reduced.

In order for it to be possible to produce the inventive control valve in a particularly favorable manner, the high-pressure supply element is preferably connected to the supply choke via an annular channel. The annular channel is thereby particularly preferably configured in a nozzle body (injector housing) and/or in the control module.

According to one preferred embodiment of the present invention the guiding device is configured as a cylindrical extension to the control module. The valve body of the injector is thereby preferably guided in a hole in the guiding device and the control compartment is arranged at the end of the hole preferably in the form of graduated hole.

In order to provide a particularly compact control module structure or a particularly compact injector, a connecting area is preferably provided on the outer periphery of the guiding device or on the inner periphery of the nozzle body. This connecting area connects the high-pressure supply element to a high-pressure area on the valve body of the injector, in order to supply fuel for an injection.

In order to allow particularly simple and economical production, the connecting area is thereby preferably formed by one or a plurality of recesses on the guiding device and/or on the nozzle body. The connecting area can thereby be produced particularly easily by grinding areas on the periphery of the cylindrical guiding device.

The guiding device preferably has a recess to guide the valve body. It is particularly preferable for said recess to be configured as a blind hole in the cylindrical guiding device.

According to a further preferred embodiment of the present invention, a nozzle spring for resetting the valve body is supported on the one hand on the guiding device and on the other hand on a spring plate arranged on the valve body.

In order to maintain a high degree of accuracy of the movement of the valve body during the fuel injection process, one or a plurality of centering surfaces are preferably configured on the guiding device to center the control module in the nozzle body.

It is particularly preferably here for the valve body of the injector to be configured as a nozzle needle.

The inventive control module for an injector is preferably used in storage-type injection systems such as common rail injectors for diesel engines. As the inventive control module combines all the necessary elements for controlling and guiding the valve body in one component, the injector can be particularly compact and economical to produce. Continuous leakage can be prevented, as there is only one flat sealed surface between the control module and the adjacent further components of the injector and this is relatively easy to seal. This can also significantly simplify functional testing of the component, as elaborate assembly of a plurality of components is not necessary. Also pressure loss and the volume of the control compartment can be kept to a low value, so that very short control times are possible with the inventive injector.

BRIEF DESCRIPTION OF THE DRAWINGS

The invention is described below with reference to a preferred exemplary embodiment in conjunction with the drawing, in which:

FIG. 2 shows a cross-sectional view along the line A—A from FIG. 1;

FIG. 3 shows an enlarged schematic cross-sectional view of the control module shown in FIG. 1.

DETAILED DESCRIPTION OF THE PREFERRED EMBODIMENTS

An exemplary embodiment according to the present invention is described below with reference to FIGS. 1 to 3.

Figure 1:
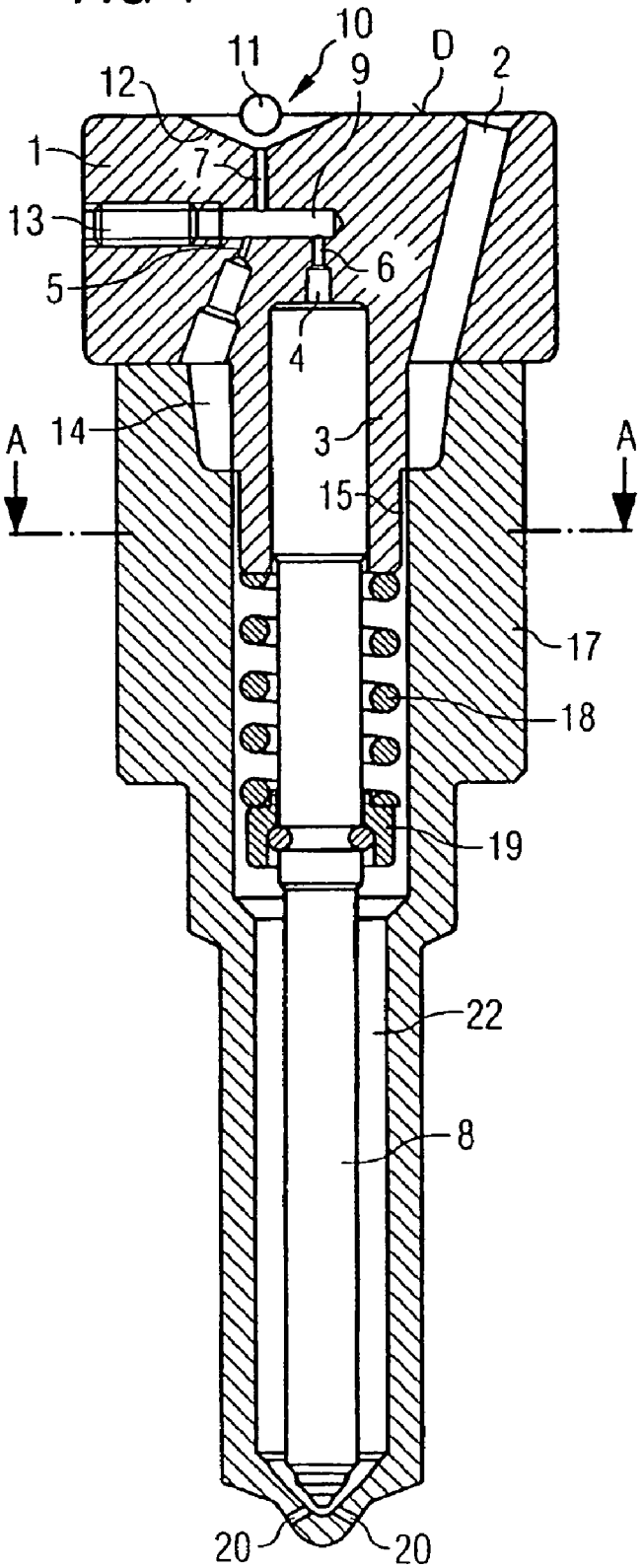
FIG. 1 shows a schematic cross-sectional representation of an injector with a control module according to an exemplary embodiment of the present invention.
Figure 4:
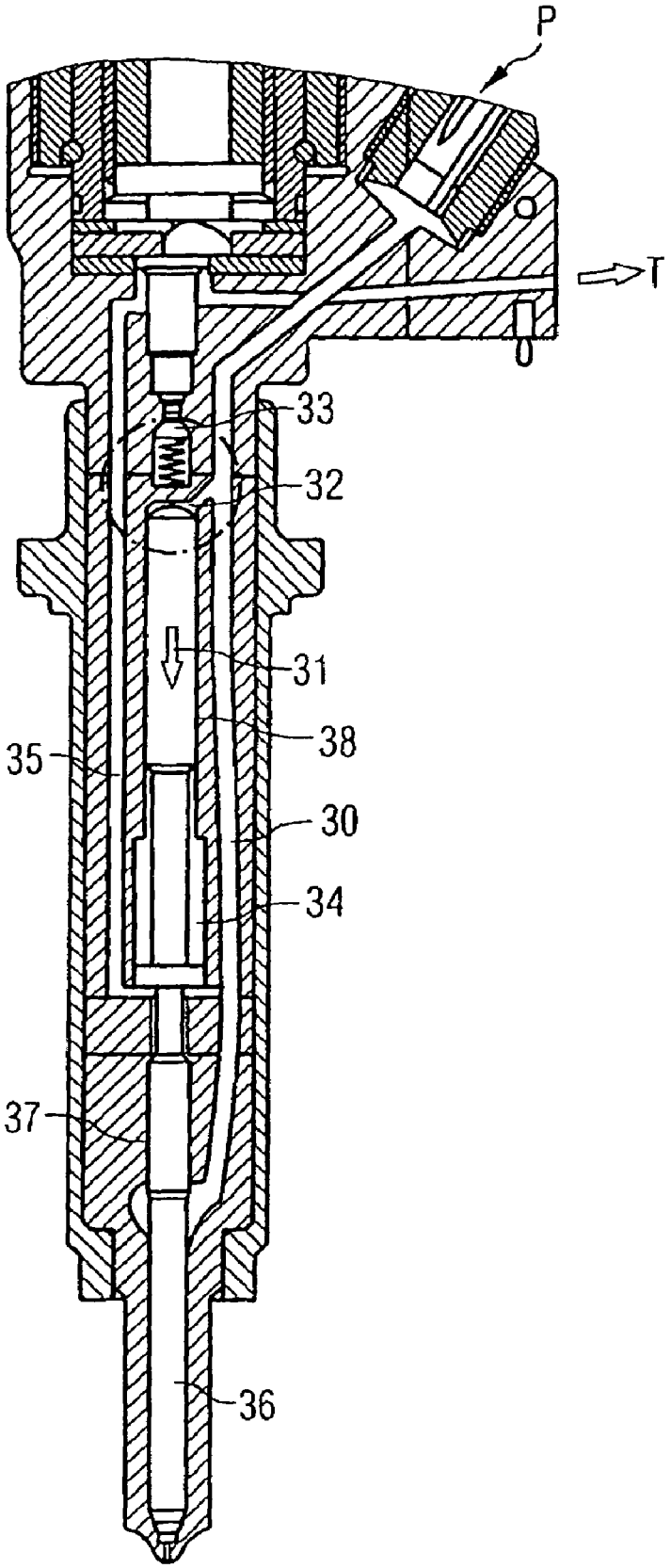
FIG 4 Prior art
FIG. 4 shows an injector for a storage-type injection system according to the prior art.

As shown in particular in FIG. 1, the inventive control module 1 for a storage-type injection system injector is very compact in structure. The control module 1 comprises a high-pressure supply element 2, to supply fuel from a high-pressure pump (not shown) to the injector. The control module 1 also comprises a cylindrical guiding device 3 for guiding a valve body 8 of the injector. A blind hole 21 is configured in the cylindrical guiding device 3 for this purpose.

The control module 1 also comprises a control compartment 4, a valve compartment 9 and a control valve 10. The control compartment 4 is connected, as shown in FIG. 1, to one end of the valve body 8. The control compartment 4 is also connected via a first output choke 6 to the valve compartment 9. The valve compartment 9 is in turn connected via a second output choke 7 to the control valve 10. The high-pressure supply line 2 is connected via an annular channel 14 via a supply choke 5 to the valve compartment 9.

As shown in particular in FIG. 3, the valve compartment 9 is formed by a lateral hole in the control module 1, which is sealed in a fluid-tight manner by means of a grub screw 13.

The inventive arrangement of the supply and output chokes 5, 6, 7 means that the control compartment 4 can have a minimum volume, which has an advantageous effect on the achievement of minimum switching times for opening and closing the valve body.

The connecting area 15 between the high-pressure supply line 2 and a high-pressure area 22 on the valve body 8 is also shown in FIGS. 2 and 3. As shown in FIG. 2, the connecting area 15 comprises four flattened areas on the outer periphery of the cylindrical guiding device 3. Centering surfaces 16 (only one is shown in FIG. 3) are configured between the individual connecting areas 15 to allow reliable centering of the control module 1 in the nozzle body 17.

As also shown in FIG. 1, a spring 18 is provided to reset the valve body 8, and said spring is supported on the one hand on the annular end of the guiding device 3 and on the other hand on a spring plate 19 attached to the valve body 8.

The function of the inventive injector is as follows: when the control valve 10 is activated by an actuator, such as a piezoactuator for example, so that a control valve element 11 of the control valve 10 is raised from a valve seat 12, the valve compartment 9 is connected via the second output choke 7 to a low-pressure area downstream from the control valve. The pressure in the valve compartment 9 therefore drops. As a result fluid flows out of the control compartment 4 via the first output choke 6 and the valve compartment 9 into the low-pressure area. The pressure in the control compartment 4 therefore drops so that the valve body 8 is moved upwards towards the control module 1 counter to the spring force of the spring 18, so that the injection openings 20 are released and the injection of fuel into a combustion chamber is facilitated. While the control valve 10 is in the opened state, only a volume restricted by the supply choke 5 can flow from the high-pressure supply element 2 via the annular channel 14, the supply choke 5, the valve compartment 9 and the second output choke 7 to the low-pressure area. The inventive embodiment of the control module also prevents continuous leakage, as the inventive control module has no further connections to the low-pressure area. The inventive control module has only one flat sealed surface D on the control module 1 between the high-pressure supply element 2 and the low-pressure area.

When injection is to be terminated, the control valve 10 is closed again via the actuator, so that the original pressure can build up again in the valve compartment 9. The control compartment 4 is thereby filled again from the valve compartment 9 via the first output choke 6. The flow direction in the first output choke 6 thereby reverses. The original pressure therefore builds up again in the control compartment 4, so that the valve body 8 moves downwards into its original position and the injection openings 20 close again and injection is terminated.

As the pressure level in the control compartment 4 is higher with the control valve 10 open than with the prior art, fast closure of the injector can be achieved. The higher pressure means that cavitation bubbles do not form at the first output choke 6 or at the control compartment 4.

The inventive injector thereby requires a minimum volume to open or close the valve body 8, resulting in a larger design margin for the choke cross-sections of the two output chokes 6 and 7 and the supply choke 5. In particular for a predefined maximum permissible volume flow at the valve seat 12 the choke cross-sections can be larger, thereby significantly reducing manufacturing costs. The inventive control module thereby has a particularly compact structure, as a plurality of functions can be provided simultaneously by the control module 1.

As shown in FIG. 1, the valve body 8 is configured as a single nozzle needle, one end of which is connected to the control compartment 4 and the other end of which releases or closes injection openings 20.

Because of the minimal volume of the control compartment 4 it is also possible with the invention for the smallest quantities of fuel to be injected with a very high degree of accuracy, as the valve body 8 can be positioned very accurately as a result.

The present invention therefore relates to a control module 1 for a storage-type injection system injector to control and guide a valve body 8, comprising a high-pressure supply element 2 to supply fuel, a guiding device 3 to guide the valve body 8 and a control compartment 4. A control valve 10, a supply choke 5, a first output choke 6 and a second output choke 7 are also provided. The supply choke 5 provides a connection between the high-pressure supply element 2 and a valve compartment 9. The first output choke 6 connects the control compartment 4, which is connected to one end of the valve body 18, to the valve compartment 9. The second output choke 7 connects the valve compartment 9 to the control valve 10.

The present invention is not restricted to the exemplary embodiment shown. Various differences and modifications can be implemented without leaving the scope of the invention.

I claim:

1. A control module for a storage-type injection system injector to control and guide a valve body, said module comprising:

a high-pressure supply element to supply fuel;

guide to guide the valve body;

a control compartment connected to one end of the valve body;

a control valve;

a valve compartment;

a supply choke;

first and second output chokes, wherein the supply choke connects the high-pressure supply element and the valve compartment, the first output choke connects the control compartment and the valve compartment, and the second output choke connects the valve compartment to the control valve.

2. A control module according to claim 1, wherein the high-pressure supply element is connected to the supply choke via an annular channel.

3. A control module according to claim 2, wherein the annular channel is configured in a nozzle body and/or in the control module.

4. A control module according to claim 1, wherein the guide is configured as a cylindrical extension.

5. A control module according to claim 4, wherein a connecting area is provided on the outer periphery of the guide and/or on the inner periphery of the nozzle body to connect the high pressure supply element to a high-pressure area on the valve body.

6. A control module according to claim 5, wherein the connecting area is formed by one or a plurality of recesses on the guide and/or on the nozzle body.

7. A control module according to claim 1, wherein the guide has a recess to guide the valve body.

8. A control module according to claim 1, wherein a spring element to reset the valve body is supported on the one hand on the guide and on the other hand on a spring plate arranged on the valve body.

9. A control module according to claim 1, wherein centering surfaces are configured on the guide to center the control module in the nozzle body.

10. A control module according to claim 1, wherein the valve body is configured as a nozzle needle.

11. A control module according to claim 1, wherein in the control module all the functional elements to control and guide the valve body of the injector are combined in one component.

12. A control module according to claim 1, wherein the high-pressure supply element is connected to the supply choke via an annular channel configured in a nozzle body and/or in the control module.

13. A control module according to claim 1, wherein the valve compartment is formed by a lateral hole in the control module.

14. A control module according to claim 1, wherein the valve body is configured as a single nozzle needle, one end of said needle connected to the control compartment and the other end of said needle releases or closes injection openings.

15. An injector for a storage-type injection system with a control module for a storage-type injection system injector to control and guide a valve body, said injector comprising:

a high-pressure supply element to supply fuel;

a guide to guide the valve body, a control compartment connected to one end of the valve body;

a control valve;

a valve compartment;

a supply choke;

first and second output chokes, wherein the supply choke connects the high-pressure supply element and the valve compartment, the first output choke connects the control compartment and the valve compartment, and the second output choke connects the valve compartment to the control valve.

16. An injector according to claim 15, wherein the high-pressure supply element is connected to the supply choke via an annular channel.

17. An injector according to claim 16, wherein the annular channel is configured in a nozzle body and/or in the control module.

18. An injector according to claim 15, wherein the guide is configured as a cylindrical extension.

19. An injector according to claim 18, wherein a connecting area is provided on the outer periphery of the guide and/or on the inner periphery of the nozzle body to connect the high pressure supply element to a high-pressure area on the valve body.

20. An injector according to claim 19, wherein the connecting area is formed by one or a plurality of recesses on the guide and/or on the nozzle body.

* * * * *